United States Patent [19]

Cruff et al.

[11] 4,057,227

[45] Nov. 8, 1977

[54] METHOD FOR MAKING CERAMIC CASTING SLURRIES

[75] Inventors: Carlton E. Cruff, Manchester; Edward G. Day, Rocky Hill, both of Conn.

[73] Assignee: United Technologies Corporation, Hartford, Conn.

[21] Appl. No.: 718,265

[22] Filed: Aug. 27, 1976

[51] Int. Cl.[2] ..... B28C 5/46

[52] U.S. Cl. ..... 366/2

[58] Field of Search ..... 164/26, 43; 259/146, 259/147, 148, 153, 178 A, 102, 185, 7, 8

[56] References Cited

U.S. PATENT DOCUMENTS

| | | | |
|---|---|---|---|
| 519,599 | 5/1894 | Bloemenday | 259/148 |
| 886,768 | 5/1908 | Bogory | 259/153 |
| 3,075,746 | 1/1963 | Yablonski | 259/102 |
| 3,589,686 | 6/1971 | Russell | 259/148 |

*Primary Examiner*—Robert W. Jenkins

*Attorney, Agent, or Firm*—Edward J. Timmer

[57] ABSTRACT

The present invention provides an improved method for making ceramic slurries useful in forming casting molds. The method involves placing the slurry ingredients in a mixing container, removing sufficient air from the container to prevent subsequent air entrapment, mixing the slurry ingredients by epicyclic agitation to effect rapid particle wetting and homogenization and removing the slurry from the container after agitation is terminated, the ceramic slurry being ready for immediate use. Total slurry preparation time is generally one hour or less, as compared to the 24 to 36 or more hours required for prior art slurry preparation techniques.

9 Claims, No Drawings

METHOD FOR MAKING CERAMIC CASTING SLURRIES

BACKGROUND OF THE INVENTION

1. Field of the Invention

The present invention relates to a method for rapidly mixing ceramic slurries for use in forming casting molds.

2. Description of the Prior Art

Investment casting is a well-known process for making metal articles of complex shape. Generally, in making a mold for investment casting, an expendable pattern, such as wax, in the shape of the article to be made is dipped in a slurry of ceramic particles, dusted with dry ceramic particulate and dried, the sequence being repeated until the desired thickness for a mold wall is obtained. Thereafter, the wax pattern is removed, such as by melting, and the ceramic layers are heated for consolidation into a strong mold to be used in casting.

The ceramic slurry used in forming the mold about the pattern is usually a suspension of insoluble ceramic powders, such as zircon, alumina, fused quartz and the like, in a binder liquid, such as colloidal silica. The ceramic powders in the slurry are provided in a range of particle sizes to achieve proper mold strength and surface finish. For example, in a typical zircon slurry, the zircon powder may include −600 mesh, −325 mesh and −140 mesh particles in selected proportions depending on the properties desired in the casting mold. U.S. Pat. No. 3,933,190 illustrates a ceramic slurry having alumina powders of various particle sizes suspended in an aqueous solution. Of course, the quality of the ceramic slurry into which the pattern is dipped is a key factor in determining whether a high quality casting mold will be eventually produced. To this end, such slurry properties as viscosity, density and temperature must be carefully controlled within critical limits during and after slurry mixing.

The usual practice for preparing such ceramic slurries involves placing the liquid binder ingredient of the slurry in a cylindrical container having a mixing impeller therein, the impeller having the general shape of an outboard motor propeller. The various ceramic powder ingredients are then added to the colloidal silica in sequence according to the surface area to weight ratio of the powder, the powder having the highest such ratio being added first and so on. For example, in making the zircon slurry mentioned above, the −600 mesh zircon powder is added first, the −325 mesh powder second the −140 mesh powder third. During such additions, the colloidal silica is slowly stirred. The sequential addition of each powder ingredient is a lengthy step in the process, in many cases requiring several hours for each powder ingredient. Such slow, sequential powder additions are necessary to ensure that the fine, difficult-to-wet powders are satisfactorily wetted be the colloidal silica and that minimal settling of the particles occurs. In addition, such slow additions are necessary to preclude entrapment of air in the slurry. Air entrapment lowers the density and raises the viscosity of the slurry which, as already mentioned, must be maintained within critical limits to assure production of high quality casting molds. Nevertheless, some air entrapment is inevitable during mixing due to the vortex action around the impeller shaft. Consequently, standard prior art practce is to stabilize the ceramic slurry after preparation to allow such entrapped air to escape from the slurry.

After stabilization, the slurry is finally ready for use in forming casting molds. As a result of the process steps involved, the prior art practice for mixing ceramic slurries is very time-consuming; requiring a total preparation time, including ingredient additions, mixing and stabilization, from 24 to 36 hours and more in many cases. During this time, numerous foundry personnel must be present to ensure porper slurry preparation.

SUMMARY OF THE INVENTION

The present invention provides an improved method for making ceramic slurries useful in the formation of casting molds.

It is an object of the present invention to provide a method for making ceramic casting slurries in extremely short times, for example, in times as short as one hour or less, heretofore unachievable in the prior art.

It is another object of the invention to provide a method for mixing the slurry ingredients wherein the slow, sequential additions of the insoluble ceramic particulate ingredients according to their surface area to weight ratios are unnecessary to minimize or avoid settling and to maximize wetting of the particles in the slurry.

It is another object of the invention to provide a method for mixing the slurry ingredients without entrapment of air in the slurry, thereby eliminating the need for stabilization of the slurry after mixing.

A typical embodiment of the invention involves placing the slurry ingredients in a mixing container, evacuating sufficient air from the container to prevent air entrapment in the slurry ingredients upon subsequent agitation and mixing the slurry ingredients by epicyclic agitation to effect rapid wetting and homogenization thereof. Thereafter, the agitation is terminated and the ceramic slurry is removed from the container for immediate use in forming casting molds. The slurry ingredients may be placed in the mixing container in any order. For example, the liquid ingredient may be added first and the ceramic particulate ingredients may then be introduced in mass or in segmented fashion, or the ceramic particulate ingredients may first be placed in the container followed by introduction of the liquid. Regardless of the order in which the slurry ingredients are placed in the mixing container, it is essential to the present invention that such ingredients be thereafter mixed by epicyclic agitation in a vacuum sufficient to preclude air entrapment.

The present invention is a significant advancement in the art of making ceramic casting slurries. A reduction in total slurry preparation time from 24 to 36 or more hours to 1 hour or less is made possible for the first time with the method of the present invention. As a result of the short slurry preparation time, the present invention is especially suited for use with automated techniques for forming casting molds wherein the ceramic slurries are rapidly consumed and require frequent replenishment.

Other objects, uses and advantages of the present invention will become apparent to those skilled in the art from the following description and claims.

DESCRIPTION OF THE PREFERRED EMBODIMENT

The present invention is illustrated hereinbelow with reference to the preparation of a ceramic casting slurry comprising zircon powder particles of various sizes suspended in a colloidal silica binder liquid. The proportions of these ingredients in the slurry are given in the following table.

| Slurry Composition | |
|---|---|
| Colloidal silica liquid | 194 lbs. |
| Zircon powders | |
| −600 mesh | 75 lbs. |
| −325 mesh | 500 lbs. |
| −140 mesh | 208 lbs. |

The slurry may also contain conventional wetting and antifoaming agents, if desired, such as selected portions of hydrodyne solution and Foamex, respectively. The slurry composition given in the table is typical of those used to form investment casting molds for the conventional and directional solidification of molten metals and alloys. Of course, it is to be understood that this exemplary composition and detailed method for preparing it are offered merely for purposes of illustration and are not intended to limit the scope of the present invention.

The initial step in practicing the method of the invention involves placing the slurry ingredients in a suitable mixing container, such as a cylindrical metal can or the like. Contrary to the prior art practice, the slurry ingredients may be introduced into the mixing container at high rates and in any order. For example, in making the zircon slurry, the colloidal silica liquid may first be placed in the container and the zircon powder ingredients thereafter added in mass or in segmented fashion, as desired. Or, the zircon powder ingredients may first be added followed by introduction of the colloidal silica liquid. Of course, other sequential additions of the slurry ingredients may be made. An important feature of the present method is that it is not necessary to add the zircon powders, or more generally, the ceramic particulate ingredients, in sequence according to their surface area to weight ratios at very slow rates in order to prevent substantial settling of these ingredients. The provision for subsequent epicyclic mixing of the slurry ingredients substantially prevents particle settling in the slurry and provides thorough particle wetting. In a preferred embodiment of the invention, it is desirable to provide for preliminary epicyclic mixing as the slurry ingredient additions are being made. This preliminary mixing is desirable to minimize overloading of the mixer motor. If air is present in the container during introduction of the slurry ingredients, the preliminary epicyclic mixing should be of sufficiently slow speed to prevent entrapment of substantial air in the slurry ingredients. A particular advantage of the present method is that slurry ingredient additions can be made in a matter of 10 minutes or less. This time may be reduced even further by utilization of conventional automatic weighing and feeding systems.

After the slurry ingredients have been placed in the mixing container, sufficient air is removed therefrom to prevent air entrapment in the slurry ingredients upon subsequent epicyclic agitation. A conventional vacuum hood enclosing the mixing container and vacuum pump attached thereto are suitable for this purpose. Alternatively, the slurry ingredients may be introduced into the mixing container after the air has been already evacuated therefrom. This technique may require that the vacuum be broken and reestablished several times in order to complete slurry ingredient additions to the container. Regardless of the technique employed, it is necessary to the success of the present invention that the vacuum level maintained in the container during epicyclic mixing be sufficient to prevent substantial air entrapment in the slurry ingredients. In mixing the zircon slurry, a vacuum represented by 22 inches of mercury has been found suitable to prevent substantial air entrapment. Of course, the vacuum level must not be so low as to cause the colloidal silica liquid to vaporize during mixing.

Once the desired vacuum level is obtained, the slurry ingredients are subjected to epicyclic agitation to effect rapid particle wetting and homogenization thereof. Such epicyclic mixing is essential to the present method to insure rapid particle wetting and homogenization. With such mixing, there are no so-called "dead spots" within the container where settling of the ceramic particulate ingredients might occur. Epicyclic agitation provides essentially complete mixing of the slurry ingredients in very short times due to the complexity of the epicyclic motion. Of course, the speed with which the mixing is conducted will depend upon the particle size, viscosity, density of the slurry ingredients being mixed and other factors. As already mentioned, the provision for epicyclic mixing of the slurry ingredients eliminates the need for the slow, sequential additions of the ceramic particulate ingredients which are necessary in the prior art to minimize settling and to maximize particle wetting. Several commercial mixing machines have been found to provide the desired epicyclic mixing action, including but not limited to, double planetary mixers manufactued by Charles Ross & Son Co., Hauppauge, New York; Vertomix mixers manufactured by Tower Iron Works Inc., Seekonk, Mass.; and Nauta mixers manufactured by The J. H. Day Co., Englewood Cliffs, New Jersey.

When epicyclic mixing of the slurry ingredients is completed, the vacuum in the container is broken and the ceramic slurry removed therefrom for immediate use in forming investment casting molds. Preferably, the ceramic slurry is discharged from the bottom or side of the container by gravitational flow. As a result of the absence of air in the container during mixing, the ceramic slurry exhibits negligible air entrapment and thus does not have to undergo the stabilization treatment required in the prior art mixing practice.

The method of the present invention is a significant advance in the art of mixing ceramic casting slurries. The total slurry preparation time has been reduced from 24 to 36 and more hours to one hour or less while at the same time providing a slurry of desired viscosity, density and the like. By way of example, a zircon slurry as described above was prepared in the HDM double planetary mixer (40 gallon) made by the Charles Ross & Son Company. The colloidal silica liquid was placed in the mixing container first. Then, the fine and coarse zircon powder were added manually in about 10 minutes while the colloidal silica liquid was subjected to preliminary epicyclic mixing, the impeller rotation being from about 10 to 20 rpm. A vacuum of 22 inches of mercury was thereafter established in the mixing container and epicyclic agitation at an impeller rotation of 35 rpm was initiated. After a total slurry preparation time of 35 minutes, including 10 minutes of ingredient addition time and 25 minutes of mixing time, a ceramic slurry of desired viscosity, density and the like was produced and ready for immediate use in forming casting molds. Addition of the slurry ingredients by automatic means could further reduce total preparation time. Before the present invention, no means were available for preparing ceramic casting slurries in such short times with acceptable properties.

Of course, those skilled in the art will recognize that other embodiments of the invention are possible. For example, a portion of the total slurry ingredients may be initially placed in the mixing container and mixed according to the invention. Thereafter, the remainder of the total slurry ingredients may be added and mixed with the initial portion. This embodiment may be desirable if the mixer is prone to overloading and the like. Those skilled in the art will also recognize that other changes, omissions and additions in the form and detail of the illustrated embodiment may be made without departing from the spirit and scope of the invention.

Having thus described a typical embodiment of our invention, that which we claim as new and desire to secure by Letters Patent of the United States is:

1. A method for rapidly preparing a ceramic slurry having controlled viscosity, density and the like for use in forming casting molds, wherein a liquid binder ingredient and insoluble ceramic particulate ingredients of various particle sizes are mixed in a container, comprising the steps of:

placing the slurry ingredients in the container in the desired amounts, including removing sufficient air from the container to prevent subsequent air entrapment in the slurry ingredients;

mixing the slurry ingredients by epicyclic agitation to effect rapid wetting and homogenization thereof, substantial air entrapment in the ingredients being prevented during mixing by said prior removal of air from the container; and terminating said agitation and removing the ceramic slurry from the container for immediate use in forming casting molds, total slurry preparation time, including placement of the ingredients in the container and epicyclic mixing, being archievable within one hour.

2. The method of claim 1 wherein the slurry ingredients are placed in the container before air is removed therefrom.

3. The method of claim 2 wherein the liquid ingredient is first placed in the container and the ceramic particulate ingredients are thereafter introduced into said container.

4. The method of claim 3 wherein the liquid ingredient is subjected to preliminary epicyclic mixing while the particulate ingredients are added, the speed of said preliminary mixing being sufficiently slow to prevent substantial air entrapment in the slurry ingredients.

5. The method of claim 2 wherein the ceramic particulate ingredients are first placed in the container and the liquid ingredient is thereafter introduced into said container.

6. The method of claim 5 wherein the particulate ingredients are subjected to preliminary epicyclic mixing while the liquid ingredient is added, the speed of said preliminary mixing being sufficiently slow to prevent substantial air entrapment in the slurry ingredients.

7. The method of claim 1 wherein the slurry ingredients are placed in the container after sufficient air has been removed therefrom to prevent air entrapment upon subsequent mixing.

8. The method of claim 1 wherein the liquid ingredient is colloidal silica.

9. The method of claim 1 wherein the particulate material is selected from the group consisting essentially of zircon powder, alumina powder, and fused quartz.

* * * * *